US008992265B2

(12) United States Patent
Eckart

(10) Patent No.: US 8,992,265 B2
(45) Date of Patent: Mar. 31, 2015

(54) PLUG-TYPE CONNECTOR

(75) Inventor: Christian Eckart, Vachendorf (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 7 days.

(21) Appl. No.: 14/111,663

(22) PCT Filed: Jan. 31, 2012

(86) PCT No.: PCT/EP2012/000426
§ 371 (c)(1),
(2), (4) Date: Nov. 20, 2013

(87) PCT Pub. No.: WO2012/139677
PCT Pub. Date: Oct. 18, 2012

(65) Prior Publication Data

US 2014/0073172 A1 Mar. 13, 2014

(30) Foreign Application Priority Data

Apr. 14, 2011 (DE) ..... 20 2011 005 270 U

(51) Int. Cl.

| | |
|---|---|
| ***H01R 13/24*** | (2006.01) |
| ***H01R 24/28*** | (2011.01) |
| ***H01R 4/48*** | (2006.01) |
| ***H01R 13/53*** | (2006.01) |
| ***H01R 13/60*** | (2006.01) |

(52) U.S. Cl.
CPC ..... *H01R 24/28* (2013.01); *H01R 4/4863* (2013.01); *H01R 13/53* (2013.01); *H01R 13/60* (2013.01)
USPC ..... 439/700

(58) Field of Classification Search
CPC ..... H01R 13/2421; H01R 23/722
USPC ..... 439/700, 66, 146, 500
See application file for complete search history.

(56) References Cited

U.S. PATENT DOCUMENTS

| | | | | |
|---|---|---|---|---|
| 3,793,606 | A | 2/1974 | Wilson | |
| 5,990,697 | A * | 11/1999 | Kazama | 324/755.05 |
| 5,993,269 | A * | 11/1999 | Ito | 439/824 |
| 6,685,492 | B2 * | 2/2004 | Winter et al. | 439/219 |
| 6,716,043 | B2 * | 4/2004 | Ishizuka | 439/131 |
| 6,758,682 | B1 * | 7/2004 | Kosmala | 439/66 |
| 6,776,668 | B1 * | 8/2004 | Scyoc et al. | 439/700 |
| 6,814,626 | B2 * | 11/2004 | Wen-Yao | 439/700 |
| 2002/0160637 | A1 * | 10/2002 | Ishizuka | 439/131 |
| 2004/0161981 | A1 * | 8/2004 | Matsui et al. | 439/824 |

FOREIGN PATENT DOCUMENTS

| | | | |
|---|---|---|---|
| DE | 102008029505 | A1 | 12/2009 |
| DE | 202010010827 | U1 | 10/2010 |

* cited by examiner

*Primary Examiner* — Phuongchi T Nguyen
(74) *Attorney, Agent, or Firm* — DeLio, Peterson & Curcio, LLC; Robert Curcio

(57) ABSTRACT

An insertion-type connector having a housing of an electrically insulating material and at least one electrically conductive first contact element and having a free end, and at least one electrically conductive second contact element, wherein the first contact element has a first plate-shaped section, and the second contact element has a second plate-shaped section, wherein the second contact element has an end which is designed for electrical connection to a cable, the plate-shaped sections arranged parallel to one another and facing one another such that the plate-shaped sections at least partially overlap one another in the direction perpendicular thereto in an overlap region and are at a specific distance from one another, wherein for the electrically conductive connection of the first contact element to the second contact element, and at least one helical spring of an electrically conductive and spring-elastic material is provided between the mutually facing plate-shaped sections.

8 Claims, 5 Drawing Sheets

PLUG-TYPE CONNECTOR

BACKGROUND OF THE INVENTION

1. Field of the Invention

The present invention relates to an insertion-type connector, and in particular to a charging connector or high-current connector, having a housing of an electrically insulating material and having at least one first contact-making member which is of an electrically conductive material and which is arranged in the housing, the housing having an insertion end which is designed for connection by insertion to a complementary insertion-type connector and having a cable end which is designed for electrical and mechanical connection to an electrically conductive cable, and the at least one first contact-making member having a free end which is adjacent the insertion end.

2. Description of Related Art

A high-current insertion-type connector for transmitting electric currents is known from DE 20 2010 010 827 U1. This has a housing of electrically conductive material which is designed for mechanical and electrical connection to a cable and which has an open end for the insertion of a mating insertion-type connector made of an electrically conductive material. Also provided is a contact-making member which is so arranged and formed in the housing that it makes electrical contact with a contact surface and produces contact-making pressure between the housing and the mating insertion-type connector inserted therein. The contact-making member has at least one annular helical spring.

SUMMARY OF THE INVENTION

Bearing in mind the problems and deficiencies of the prior art, it is therefore an object of the present invention to improve an insertion-type connector of the above kind to the effect that contacts able to be moved relative to one another are possible within the insertion-type connector.

This object is achieved in accordance with the invention by an insertion-type connector of the above kind which has the features characterized in the claims.

The above and other objects, which will be apparent to those skilled in the art, are achieved in the present invention which is directed to an insertion-type connector including: a housing of an electrically insulating material, the housing having an insertion end which is designed for connection by insertion to a complementary insertion-type connector and having a cable end which is designed for electrical and mechanical connection to an electrically conductive cable; at least one first contact-making member which is of an electrically conductive material and which is arranged in the housing, the at least one first contact-making member having a free end which is adjacent the insertion end, and a first blade-like portion; at least one second contact-making member which is of an electrically conductive material and which has an electrically conductive connection to the first contact-making member and is arranged in the housing, the second contact-making member having a second blade-like portion, and an end adjacent the cable end of the insertion-type connector for electrical connection to the cable; wherein the blade-like portions of the two contact-making members are arranged parallel to one another and face towards one another in a direction perpendicular to themselves and in a region of overlap, the blade-like portions at least partly overlap and are at a predetermined distance from one another; there being provided, in the region of overlap, between the blade-like portions which face towards one another and for the electrically conductive connection of the first contact-making member to the second contact-making member, at least one helical spring which is of an electrically conductive and resilient material and which makes electrical contact with the first contact-making member with a first contact-making pressure, on the first blade-like portion, at at least one first contact surface and which makes electrical contact with the second contact-making member with a second contact-making pressure, on the second blade-like portion, at at least one second contact surface, the helical spring being of an annular form and defining an area in space within the annulus, the area being parallel to a longitudinal axis of the helical spring at its boundary relative to the helical spring, the helical spring being so arranged that at least part of the area is arranged between and parallel to the blade-like portions in the region of overlap, and the helical spring fitting partly around the surface of the first contact-making member.

The helical spring may include turns wound at an oblique angle. The helical spring is arranged between the two blade-like portions, in the region of overlap, such that at least one portion of a first axial side of the annular helical spring makes electrical and mechanical contact with the first blade-like portion and that at least one portion of a second axial side of the annular helical spring which is opposite from the first axial side makes electrical and mechanical contact with the second blade-like portion.

The distance between the blade-like portions of the contact-making members is smaller than the outside diameter of the helical spring.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
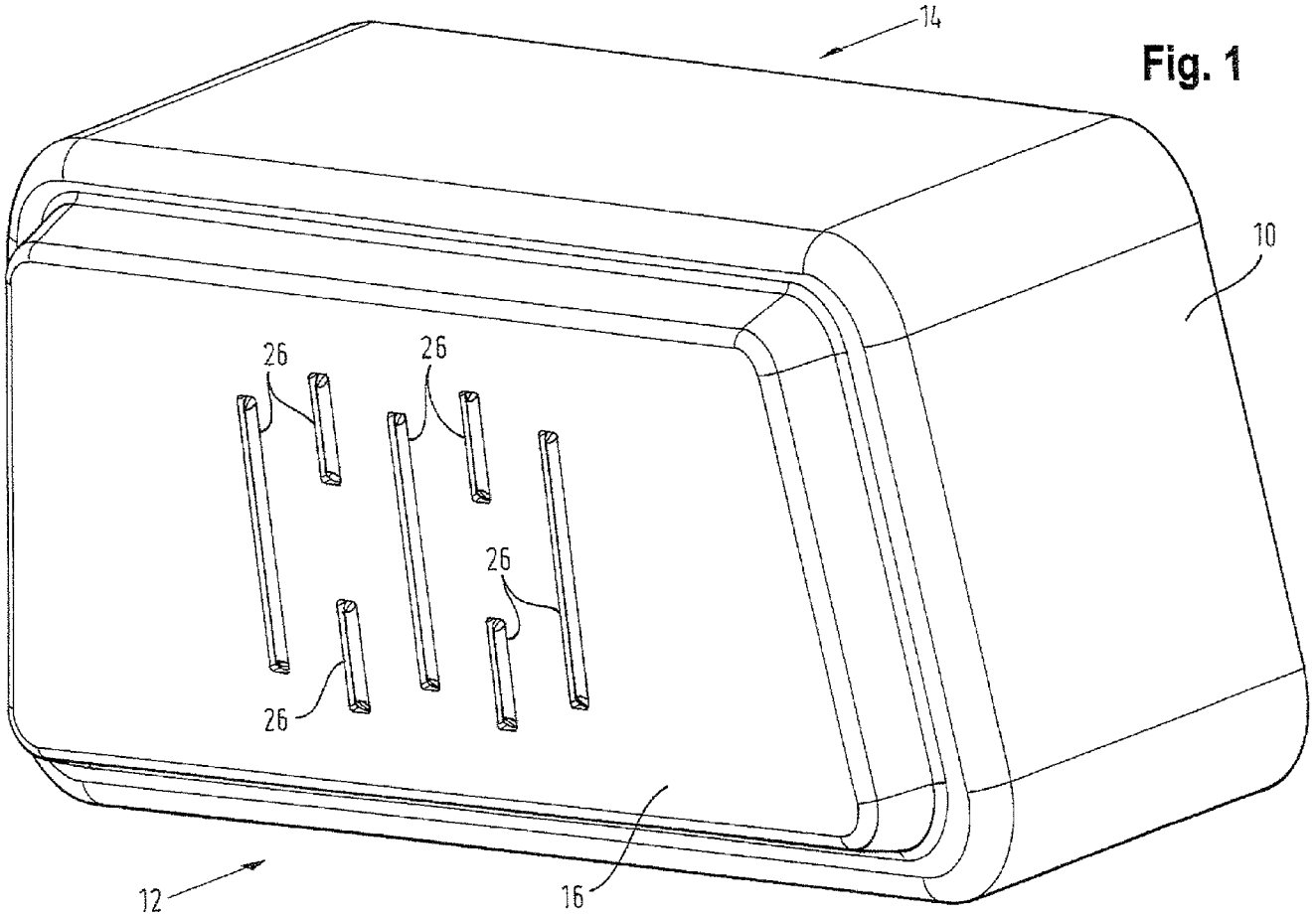
FIG. 1 is a perspective view of a preferred embodiment of insertion-type connector according to the invention in a state where the contact-making members are withdrawn.

In describing the preferred embodiment of the present invention, reference will be made herein to FIGS. 1-5 of the drawings in which like numerals refer to like features of the invention.

In an insertion-type connector of the above kind, provision is made in accordance with the invention for at least one second contact-making member which is of an electrically conductive material and which has an electrically conductive connection to the first contact-making member to be arranged in the housing, the first contact-making member having a first blade-like portion and the second contact-making member having a second blade-like portion, the second contact-making member having an end, adjacent to the cable end of the insertion-type connector, which is designed for electrical connection to the cable, the blade-like portions of the two contact-making members being arranged parallel to one another and to face towards one another in such a way that, in a direction perpendicular to themselves and in a region of overlap, the blade-like portions at least partly overlap and are at a predetermined distance from one another, there being provided, in the region of overlap, between the blade-like portions which face towards one another and for the electrically conductive connection of the first contact-making member to the second contact-making member, at least one helical spring which is of an electrically conductive and resilient material and which makes electrical contact with the first contact-making member with a first contact-making pressure, on the first blade-like portion, at the at least one first contact surface, and which makes electrical contact with the second contact-making member with a second contact-making pressure, on the second blade-like portion, at the at least one second contact surface.

This has the advantage that the first contact-making member can be moved relative to the housing and the second contact-making member without the electrical contact between the two contact-making members being adversely affected when this is done. This makes the point of electrical contact particularly suitable for transmitting high currents, such for example as ones of an intensity of 100 to 400 A or more, and, because of the movable first contact-making member, it can at the same time be equipped with a means of protection against electric shock for the electrical contacts of the insertion-type connector.

Particularly good electrical contact produced by a high contact-making pressure is achieved by virtue of the helical spring having turns wound at an oblique angle.

A particularly large number of contact surfaces together with a commensurate improvement in the electrical properties of the insertion-type connector are obtained by making the helical spring of an annular form.

A particular even distribution of the contact-making pressure over the contact surfaces is achieved by arranging the annular helical spring between the two blade-like portions, in the region of overlap, in such a way that at least one portion of a first axial side of the annular helical spring makes electrical and mechanical contact with the first blade-like portion and that at least one portion of a second axial side of the annular helical spring which is opposite from the first axial side makes electrical and mechanical contact with the second blade-like portion.

A particularly large number of contact surfaces between the helical spring and the blade-like portions of the contact-making members are obtained in the region of overlap by virtue of the fact that the annular helical spring defines an area in space within the annulus, the area being parallel to a longitudinal axis of the helical spring at its boundary relative to the helical spring and the helical spring being so arranged that at least part of this area is arranged between and parallel to the blade-like portions in the region of overlap.

Particularly good mechanical fixing of the helical spring to the first contact-making member is achieved by arranging the helical spring in such a way that it fits partly round the surface of the first contact-making member.

A further increase in the contact-making pressure together with a commensurate improvement in the electrical properties of the insertion-type connector is achieved by tilting the turns of the helical spring relative to a longitudinal axis of the helical spring by making the distance between the blade-like portions of the contact-making members smaller than the outside diameter of the helical spring.

Figure 2:
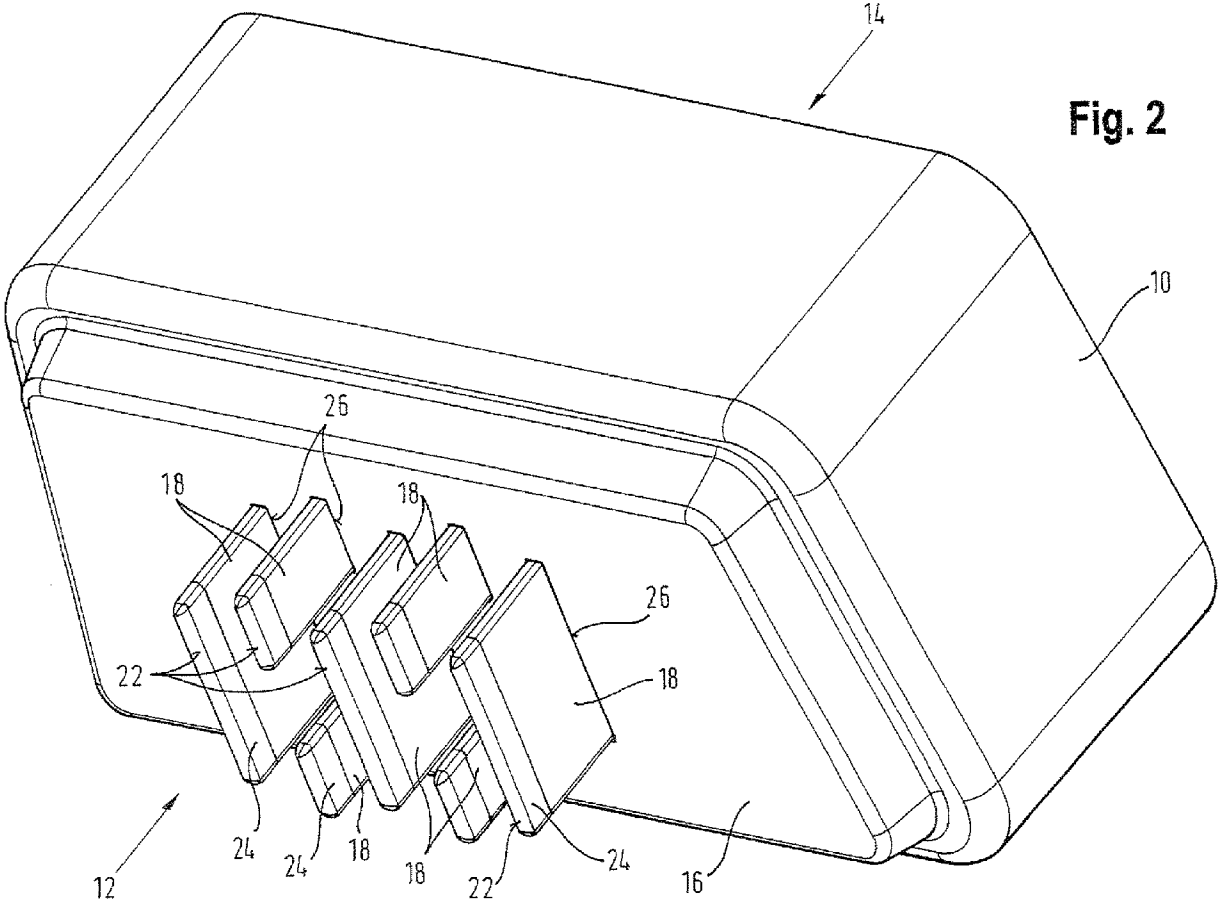
FIG. 2 is a perspective view of the insertion-type connector shown in FIG. 1 in a state where the contact-making members are fully extended.
Figure 3:
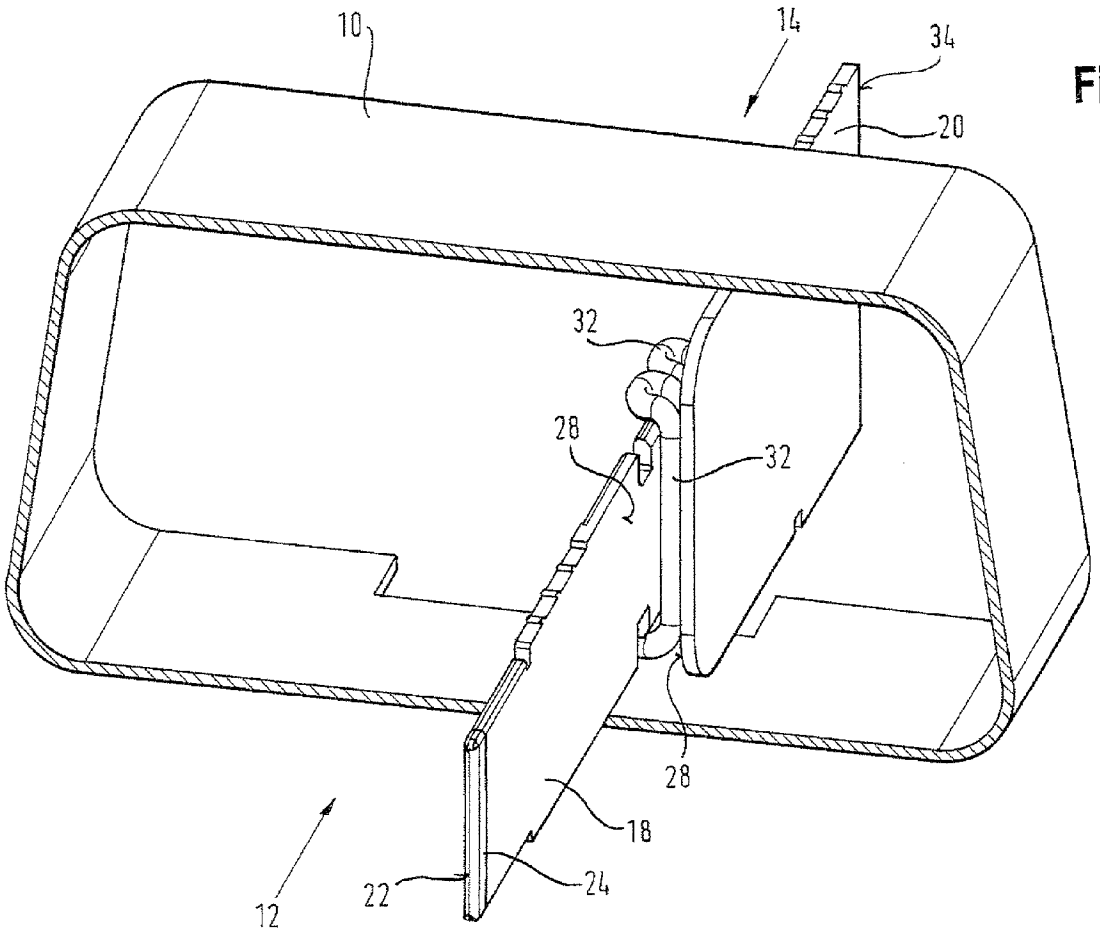
FIG. 3 is a partly broken-away perspective view of the insertion-type connector shown in FIG. 1.

The preferred embodiment of insertion-type connector according to the invention which is shown in FIGS. 1 to 5 comprises a housing 10 having an insertion end 12 and a cable end 14. A cover 16 is provided on the housing 10 at the insertion end 12. The insertion end 12 is designed for connection by insertion to, or in other words plugging together with, a complementary insertion-type connector (not shown), when at least one electrical contact is to be made between the insertion-type connector according to the invention and the complementary insertion-type connector. For this purpose, there are provided in the housing 10 at least one pair of contact-making members made of an electrically conductive material comprising a first contact-making member 18 and a second contact-making member 20, as can be seen from FIG. 3. For reasons of greater clarity, only one pair of these contact-making members 18, 20 are shown in FIG. 3 but the illustrative embodiment does in fact have seven such pairs. For reasons of greater clarity, the mounting and guidance of the contact-making members 18, 20 in the housing 10 are likewise not shown in any of the drawings. The first contact-making member 18 has a free end 22 which is adjacent the insertion end 12. Arranged on a terminal face of the free end 22 is an end-cap 24 made of an electrically insulating material which completely covers it.

Figure 4:
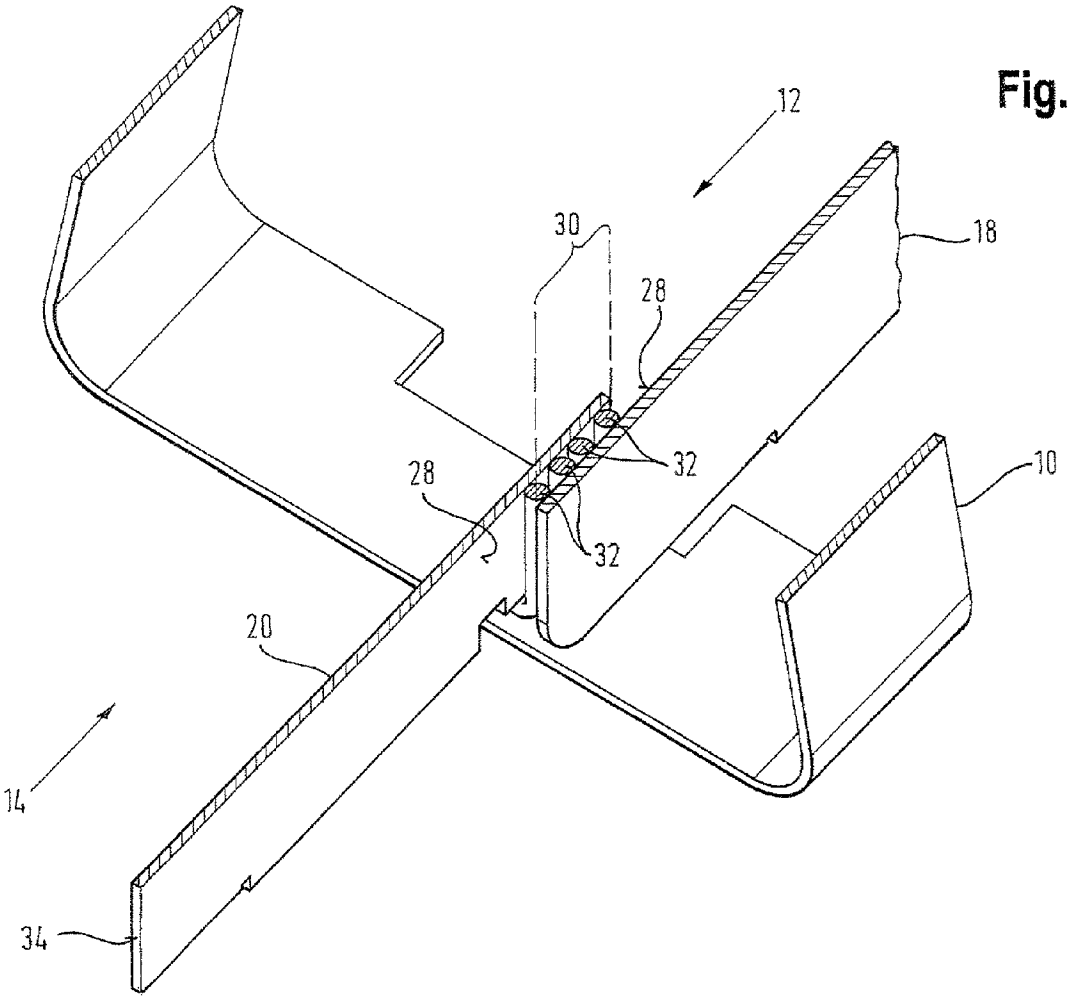
FIG. 4 shows the insertion-type connector shown in FIG. 1 when a first contact-making member is in a second, extended, position.
Figure 5:
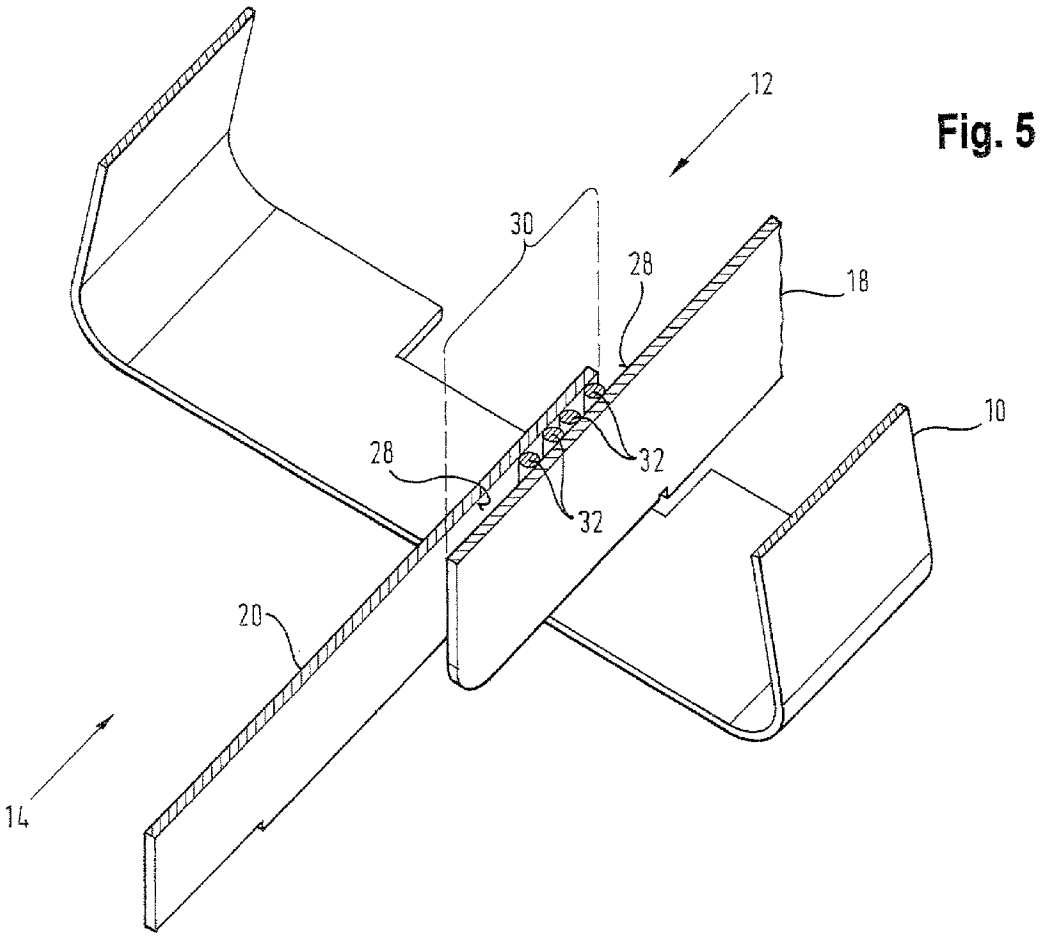
FIG. 5 shows the insertion-type connector shown in FIG. 1 when a first contact-making member is in a first, withdrawn, position.

The first contact-making member 18 of any given pair is movable relative to the housing 10 and the second contact-making member 20 between a first position as shown in FIGS. 1 and 5 and a second position as shown in FIGS. 2 and 4. The second contact-making member 20 is arranged in a fixed position relative to the housing 10. For reasons of greater clarity, a mechanism for moving the first contact-making members 18 is not shown in the drawings. In the first position, the first contact-making member 18 is drawn back into a space bounded by the housing 10 and the cover 16. In the second position, the first contact-making member 12 is slid out of the housing 10 through a given aperture 26 in the cover 16 and thus projects beyond the cover 24 and the housing 10 in the direction towards the insertion end 12.

In the first position, there is thus protection against unwanted electric shock of an operator by the first contact-making members 18 when the insertion-type connector according to the invention is not inserted in a complementary insertion-type connector and the insertion end 12 is thus freely accessible. At the insertion end 12 it is only the electrically insulating cover 16 and electrically insulated housing 10 together with the end-caps 24 which are exposed. A voltage can thus be applied to the first contact-making members 18 even when the insertion-type connector according to the invention is in the unplugged state without this creating any risk to an operator due to unwanted contact with the first contact-making members 18 at an electrically conductive point.

Once the insertion-type connector according to the invention has been plugged together with a complementary insertion-type connector, the first contact-making members 18 are extended through the cover 16 from the first position to the second position, the first contact-making members 18 of each pair thus making contact electrically with corresponding contact-making members in the complementary insertion-type connector. Conversely, before the insertion-type connector according to the invention and the complementary insertion-type connector are pulled apart again, the first contact-making members 18 are pulled back again from the second position to the first position. There is preferably provided an appropriate first securing mechanism which only permits the first contact-making members 18 to move from the first position to the second position if the insertion-type connector according to the invention is fully inserted in the complementary insertion-type connector. It is also preferable for a second securing mechanism to be provided which prevents the insertion-type connector according to the invention and the complementary insertion-type connector from being unplugged from one another for as long as the first contact-making members 18 are not in the first position.

At its cable end 14, the insertion-type connector according to the invention is connected to at least one electrically conductive cable. To decouple the movement of the first contact-making members 18 from the cable end 14, or in other words from the cable, there is provided for each movable first contact-making member 18 the respective second contact-making member 20 which is fixed relative to the housing 10, as shown in FIGS. 3 to 5. For reasons of clearer clarity, only one pair of first and second contact-making members 18, 20 is shown in each of FIGS. 3 to 5.

The first contact-making member 18 and second contact-making member 20 making up a pair are each of a blade-like form and the first and second contact-making members 18, 20 in each pair are arranged parallel to one another in such a way that respective wide sides 28 of the first and second contact-making members 18, 20 are adjacent one another. Also, at least one helical spring 32 made of an electrically conductive and resilient material is arranged, in a region of overlap 30 (FIGS. 4 and 5), between the blade-like contact-making members 18, 20 which form a pair of first and second contact-making members 18, 20. The diameter of the helical spring 32 in the region of overlap 30 and a distance, in this region of overlap 30, between the blade-like contact-making members 18, 20, i.e. between the wide sides 28 of a pair of first and second contact-making members 18, 20, are so selected that respective turns of the helix of the helical spring 32 rest against the first contact-making member 18 by a first radial outer side and against the second contact-making member 20 by a second outer side opposite from the first radial outer side, thus producing between the turns of the helical spring 32 and the respective contact-making members 18, 20, a point where electrical contact is made with a contact surface by a contact-making pressure. The contact-making pressure sets itself by virtue of the fact that the turns of the helical spring 32 are deflected from respective rest positions relative to a longitudinal axis of the helical spring 32 or in other words are tilted relative to the longitudinal axis of the helical spring 32. This is achieved by making the distance between the blade-like contact-making members 18, 20 forming a pair of first and second contact-making members 18, 20 smaller than the outside diameter of the helical spring 32.

The helical spring 32 is fastened to the first contact-making member 18, which means that the helical spring 32 moves with the first contact-making member 18. When there is a movement of the first contact-making member 18, the turns of the helical spring 32 thus rub along the second contact-making member 20 and thereby maintain an adequate electrical connection between the two contact-making members 18, 20.

The second contact-making members 20 each have a free end which has a terminal end-face 34, this free end being adjacent the cable end 14 of the insertion-type connector according to the invention. The terminal end-face 34 is used for example to make electrical contact with a core or electrical conductor of a cable which is to be connected to the insertion-type connector according to the invention.

The helical spring 32 is preferably of an annular form and defines an area of space within its annulus. At the point in question and at its own boundaries relative to the helical spring 32, this area is aligned parallel to the longitudinal axis of the helical spring 32. Because of its annular form, in principle the helical spring 32 creates in space a torus which has two opposing axial ends. In accordance with the invention, the helical spring 32 is so arranged in the region of overlap 30 between the two contact-making members 18, 20 that the helical spring 32 butts against the first contact-making member 18 by turns at one axial end and against the second contact-making member 20 by turns at the other, opposite, axial end, as can be seen from FIG. 3. In other words, neither of the contact-making members 18, 20 fits through the area in the annulus of the annular helical spring 32 and instead the making of electrical contact between the helical spring 32 and the contact-making members 18, 20 takes place at axial ends of the annular helical spring 32. Because of this the helical spring 32 can be securely fastened to the first contact-making member 18 and is secured against slipping or twisting if there is a movement of the first contact-making member 18 relative to the second contact-making member 20. As can also be seen from FIG. 3, the area enclosed within the annulus of the helical spring 32 fits partly round the first contact-making member 18. This provides additional assistance with the fixing of the helical spring 32 not only at the location of the first contact-making member 18 but also against any deformation of the annular form of the helical spring 32 between the contact-making members 18, 20.

Because they are seen in section, the annular helical springs 32 are not shown in their entirety in FIGS. 4 and 5. The annulus, or rather the area defined within the annulus, fits round the first contact-making member 18 on the narrow side of the blade-like portion of the first contact-making member 18. In the illustrative views shown in FIGS. 4 and 5 four helical springs 32 are provided. It is however also possible for any other number to be provided in a region 30 where a pair 18, 20 overlap, such for example as one, two, three, five or six helical springs 32.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An insertion-type connector including:

a housing of an electrically insulating material, the housing having an insertion end which is designed for connection by insertion to a complementary insertion-type connector and having a cable end which is designed for electrical and mechanical connection to an electrically conductive cable;

at least one first contact-making member which is of an electrically conductive material and which is arranged in the housing, the at least one first contact-making member having a free end which is adjacent the insertion end, and a first blade-like portion;

at least one second contact-making member which is of an electrically conductive material and which has an electrically conductive connection to the first contact-making member and is arranged in the housing, the second contact-making member having a second blade-like portion, and an end adjacent the cable end of the insertion-type connector for electrical connection to the cable;

wherein the blade-like portions of the two contact-making members being are arranged parallel to one another and face towards one another in a direction perpendicular to themselves and in a region of overlap, the blade-like portions at least partly overlap and are at a predetermined distance from one another;

there being provided, in the region of overlap, between the blade-like portions which face towards one another and for the electrically conductive connection of the first contact-making member to the second contact-making member, at least one helical spring which is of an electrically conductive and resilient material and which makes electrical contact with the first contact-making member with a first contact-making pressure, on the first blade-like portion, at at least one first contact surface and which makes electrical contact with the second contact-making member with a second contact-making pressure, on the second blade-like portion, at at least one second contact surface, the helical spring being of an annular form and defining an area in space within the annulus, the area being parallel to a longitudinal axis of the helical spring at its boundary relative to the helical spring, the helical spring being so arranged that at least part of the area is arranged between and parallel to the blade-like portions in the region of overlap, and the helical spring fitting partly around the surface of the first contact-making member.

2. The insertion-type connector of claim 1, wherein the annular helical spring is arranged between the two blade-like portions, in the region of overlap, such that at least one portion of a first axial side of the annular helical spring makes electrical and mechanical contact with the first blade-like portion and that at least one portion of a second axial side of the annular helical spring which is opposite from the first axial side makes electrical and mechanical contact with the second blade-like portion.

3. The insertion-type connector of claim 1, wherein the distance between the blade-like portions of the contact-making members is smaller than the outside diameter of the helical spring.

4. The insertion-type connector of claim 1, wherein said connector is a charging connector or high current connector.

5. The insertion-type connector of claim 1, wherein the helical spring includes turns wound at an oblique angle.

6. The insertion-type connector of claim 5, wherein the distance between the blade-like portions of the contact-making members is smaller than the outside diameter of the helical spring.

7. The insertion-type connector of claim 5, wherein the annular helical spring is arranged between the two blade-like portions, in the region of overlap, such that at least one portion of a first axial side of the annular helical spring makes electrical and mechanical contact with the first blade-like portion and that at least one portion of a second axial side of the annular helical spring which is opposite from the first axial side makes electrical and mechanical contact with the second blade-like portion.

8. The insertion-type connector of claim 7, wherein the distance between the blade-like portions of the contact-making members is smaller than the outside diameter of the helical spring.

* * * * *

UNITED STATES PATENT AND TRADEMARK OFFICE

CERTIFICATE OF CORRECTION

PATENT NO. : 8,992,265 B2
APPLICATION NO. : 14/111663
DATED : March 31, 2015
INVENTOR(S) : Christian Eckart It is certified that error appears in the above-identified patent and that said Letters Patent is hereby corrected as shown below:

In the claims:

In Column 7, Line 2 delete "being"

Signed and Sealed this
Third Day of November, 2015

Michelle K. Lee

Michelle K. Lee
*Director of the United States Patent and Trademark Office*